US006769537B2

(12) United States Patent
Appelabaum

(10) Patent No.: US 6,769,537 B2
(45) Date of Patent: Aug. 3, 2004

(54) THREE-PIECE PACKAGE WITH INNER TRAY

(76) Inventor: Paul Appelabaum, 16371 Wimbledon La., Huntington Beach, CA (US) 92649

( * ) Notice: Subject to any disclaimer, the term of this patent is extended or adjusted under 35 U.S.C. 154(b) by 152 days.

(21) Appl. No.: 10/188,672

(22) Filed: Sep. 9, 2002

(65) Prior Publication Data

US 2004/0045867 A1 Mar. 11, 2004

(51) Int. Cl.[7] ..... A45C 13/10

(52) U.S. Cl. ..... 206/1.5; 206/562; 206/564; 220/324

(58) Field of Search ..... 206/1.5, 426, 560, 206/562, 564, 551, 438, 499, 363; 220/324, 326, 822, 823, 824, 826, 833, 837

(56) References Cited

U.S. PATENT DOCUMENTS

| | | | | | |
|---|---|---|---|---|---|
| 3,070,868 | A | * | 1/1963 | Dell et al. | 27/35 |
| 3,997,072 | A | * | 12/1976 | Guth | 220/324 |
| 4,750,619 | A | * | 6/1988 | Cohen et al. | 206/438 |
| 4,782,977 | A | * | 11/1988 | Watanabe et al. | 220/324 |
| 5,573,741 | A | * | 11/1996 | Riley | 422/300 |

* cited by examiner

*Primary Examiner*—Shian T. Luong

(57) ABSTRACT

A clear plastic package for securing and displaying articles of commerce includes a bottom piece having a generally flat rectangular configuration including an upper surface, a perimeter edge, a front wall pivotally attached to the front end of the bottom piece, and a rear wall pivotally attached to the rear end, each end wall having a latching lip portion.

The second piece is a tray, with a lower portion that is slidably supported by the upper surface of the bottom piece and includes an upper surface with recesses for holding the articles of commerce, and the tray front end is configured to be grasped by hand.

The third piece is a generally rectangular cover, with a top wall, generally vertical opposing sidewalls, a rear wall and an open front end. With the tray positioned on the bottom the cover can be mounted over the tray with its lower edge mounted to the perimeter edge of the bottom piece. When the cover and the bottom piece are so engaged, the front and rear end walls of the bottom piece can be rotated upwardly so that their lip portions snap resiliently into holding engagement with upper ends of the cover, so as to firmly secure the cover to the bottom piece.

The front-end wall is scored with perforations to facilitate the cutting away of a major part of the wall to create an opening to allow the handle-equipped end of the inner tray to be grasped so that it can be removed.

11 Claims, 3 Drawing Sheets

THREE-PIECE PACKAGE WITH INNER TRAY

BACKGROUND OF THE INVENTION

1. Field of the Invention

The present invention relates generally to clear plastic packages for small articles of commerce, and more particularly to a package of three pieces, including two pieces that form a shell for a third, tray-like piece.

2. Description of the Prior Art

Despite advances in clear plastic packaging for small articles, such packages remain susceptible to pilferage and tampering. Also, there is no incentive, other than to discard the plastic package after the purchased items are removed from the package.

SUMMARY OF THE INVENTION

In view of the foregoing it is a general object of the present invention to provide a clear plastic package that is quite strong and secure against tampering, yet which displays the product well.

Another object is to provide an environmentally friendly package.

A further object is to provide a package that can be retained after purchase and used as a tray-equipped storage box.

Yet another object of the invention is to provide a very secure package that uses a minimal amount of adhesive in its fabrication.

The present invention provides these and other objects and advantages in the form of a three-piece package that includes a bottom piece having an upper surface and a perimeter shaped to make holding engagement with a correspondingly shaped member. There is a front wall pivotally attached to the front end of the bottom piece, and a rear wall pivotally attached to the rear end of the bottom piece, each end wall having a lip portion with latching means, and being pivotable from a horizontal position to a generally vertical position. In a preferred embodiment the bottom perimeter is an upwardly projecting edge.

The second piece is a tray that has at least one upwardly facing recess for holding articles of commerce, and a forward portion is adapted to be grasped by hand. The lower part of the tray is slidably supported by the bottom piece upper surface. In a preferred embodiment the recesses are formed in a raised upper wall of the tray.

Finally there is a cover piece with a top wall, opposing sidewalls and rear wall, and open front, and a lower edge for engaging the bottom piece perimeter to hold against relative lateral and downward movement. With the tray centrally positioned on the bottom piece upper surface, the cover can be mounted to the bottom so as to cover the tray, the open end of the cover being large enough to allow passage of the tray there through.

The bottom end walls can be swung upwardly toward positions where their lip portions snap into engagement with upper edges of the cover so as to secure the cover to the bottom.

Preferrably, UV curable adhesive is applied to interconnecting surfaces of the cover and end walls prior to rotation of the walls, for subsequent curing to affix the connection.

Finally it is noted that a major part of the forward end wall is adapted to be cut away to allow access to the handle of the tray so it can be withdrawn from and repositioned in the otherwise sealed package, as desired.

DETAILED DESCRIPTION OF THE INVENTION

Figure 1:
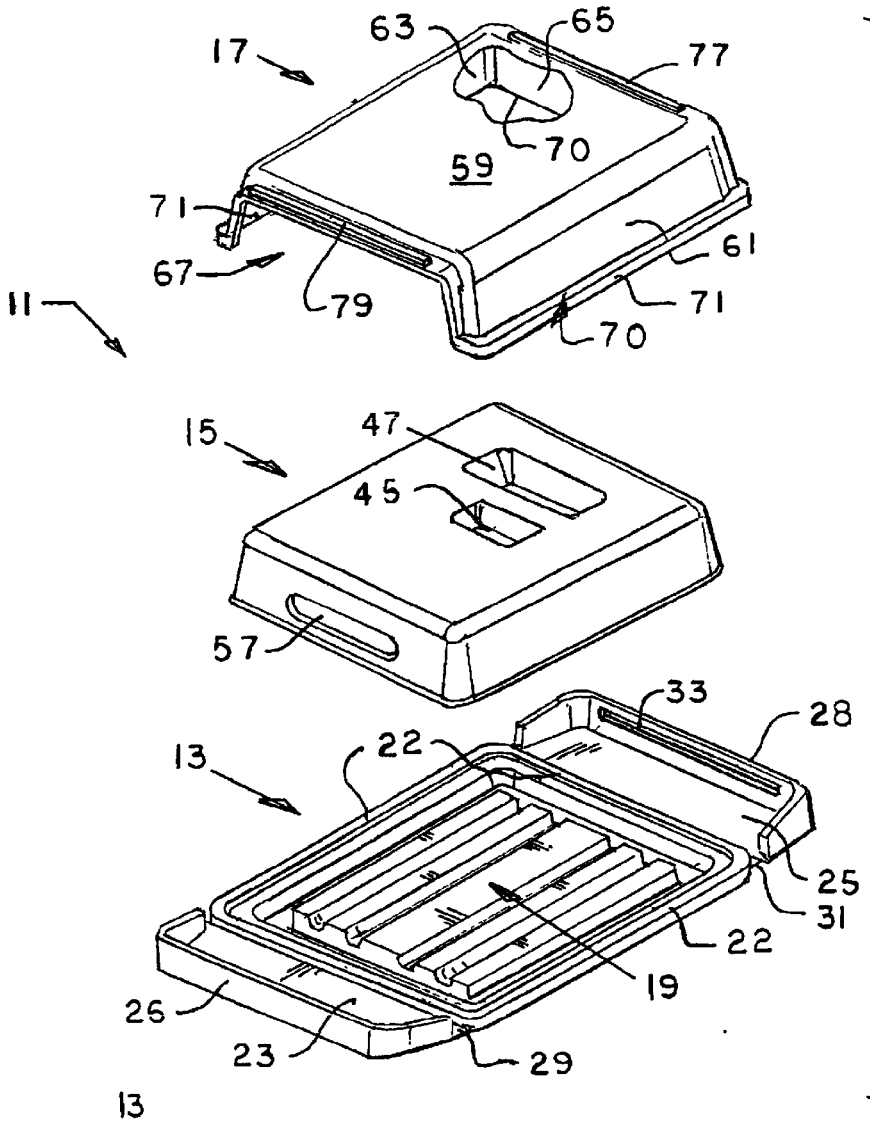
FIG. 1 is an exploded view in perspective, showing the three components of a package according to a preferred embodiment of the invention.

Referring now to the drawings, FIG. 1 shows that a package 11 according to a preferred embodiment of the invention, includes a bottom piece 13, an article-carrying piece 15, and a cover 17, all constructed of a clear plastic material using conventional plastic molding techniques.

Figure 2:
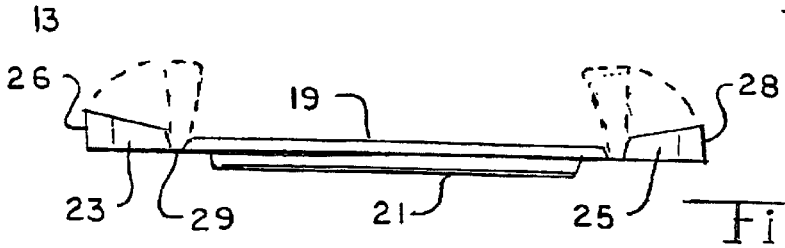
FIG. 2 is a side elevational view of the bottom piece shown in FIG. 1.

The bottom piece 13, shown in FIGS. 1 and 2, includes a central portion 19 with a bottom surface 21 for engaging a flat surface. Bottom piece 13 features pivotable front and rear end walls 23 and 25 respectively that are connected to opposite ends of the main portion 19 by living hinges 29 and 31 respectively. Note the lip portions 26 and 28 on the walls 23 and 25, respectively. FIG. 2 illustrates how the hinged walls 23 and 25 can be rotated from generally horizontal positions to vertical positions, in a manner to be described hereinafter for securing the cover to the bottom piece. Note the latching notch 33 on the inside edge of end wall lip portion 28. The wall 23 is similarly equipped with a transverse latching notch (not shown). FIG. 1 shows how portion 19 of the bottom piece is preferably strengthened in conventional manner with a number of longitudinally extending ribs. There is a perimeter edge 22 extending around the portion 19.

Figure 3:
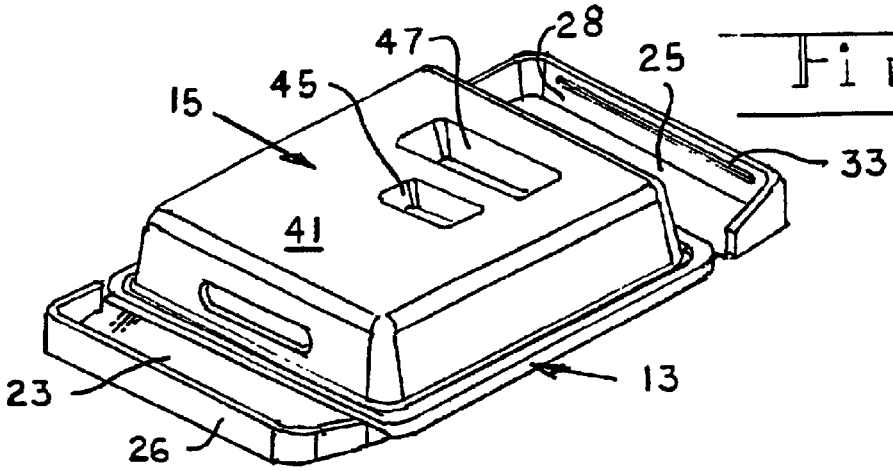
FIG. 3 is a perspective view showing the article-mounting piece, the middle piece of FIG. 1, mounted to the bottom piece.

FIG. 1 shows that the article-carrying piece 15 includes an upper surface 41, which in this particular embodiment of the invention is equipped with recesses 45 and 47 for receiving various articles of commerce. FIG. 3 shows the article-carrying piece 15 with its lower edge supported by the upper surface of the bottom piece 13. Note how the front end of piece 15 is formed to provide a grip 57.

The third piece is the cover 17, which is shown in FIG. 1 to include a top wall 59, opposing sidewalls 61 and 63, a rear wall 65, an open front 67, and lower edge 70. Note the transverse locking ridges 77 and 79 on the upper ends respectively, of the cover 17. Ridge 77 is designed to snap into latching engagement with the notch 33, and the ridge 79 with a corresponding notch on the other lip 26 when the cover is latched to the bottom in a manner to be described. The lower edge 70 including lip 71, is shaped to embrace the bottom perimeter edge 22.

Figure 4:
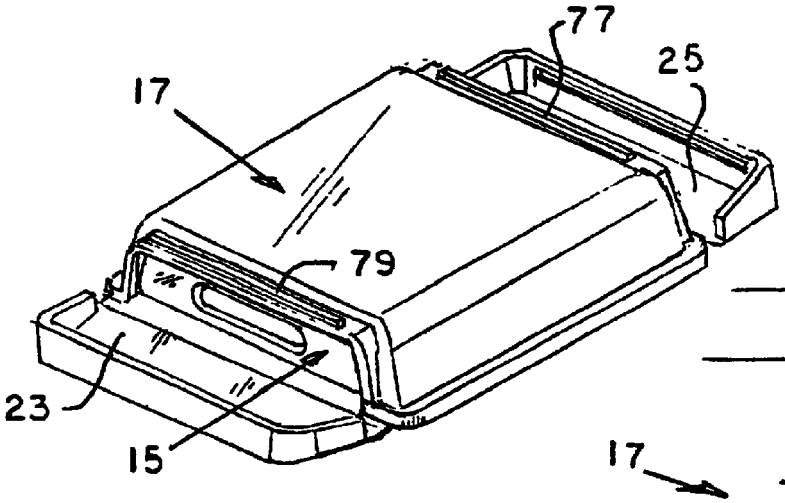
FIG. 4 is a view similar to FIG. 3, but with the cover mounted to the bottom piece and covering the article-mounting piece.
Figure 6:
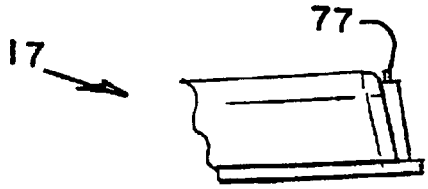
FIG. 6 is a partial elevational view of the cover.

FIG. 1 shows the order of assembly of the pieces of the invention and in FIG. 3 article-carrying piece 15 is shown mounted to the bottom piece 13 with its lower edge slidably supported by the upper surface of the bottom piece 13. Next, the cover 17 can be placed over the article-carrying piece 15 and mounted to the bottom portion 19, the cover lower edge 70 embracing the bottom perimeter edge 22 to stabilize the cover to the bottom against relative lateral and downward movement. FIG. 4 is a view of the package with the cover 17 so-positioned.

Now, the end walls 23 and 25 can be rotated upwards in the fashion shown in FIG. 2, to lock the cover to the bottom. Only a small economic quantity of UV-curable adhesive, preferably, need be applied to the ridges 77 and 79 before the two end walls are closed, so that the completed package can then be quickly affixed in its closed configuration by conveyance through a UV reactor chamber.

Figure 5:
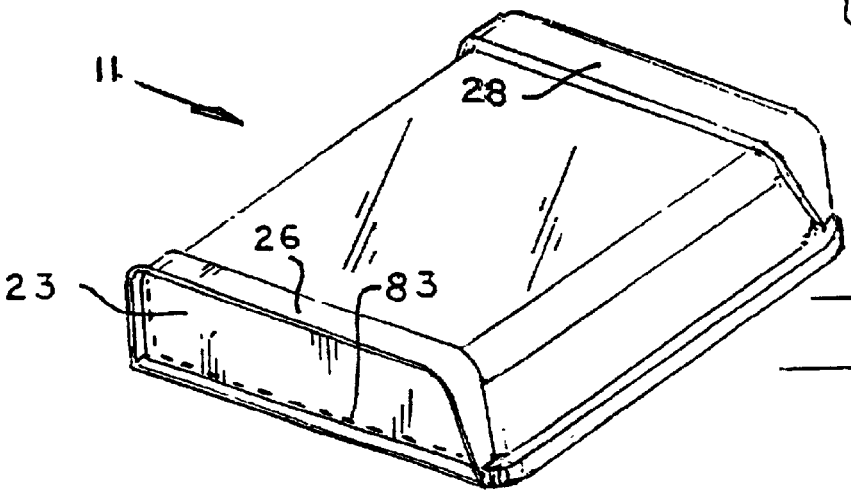
FIG. 5 is a perspective view of a completed, sealed package.
Figure 7:
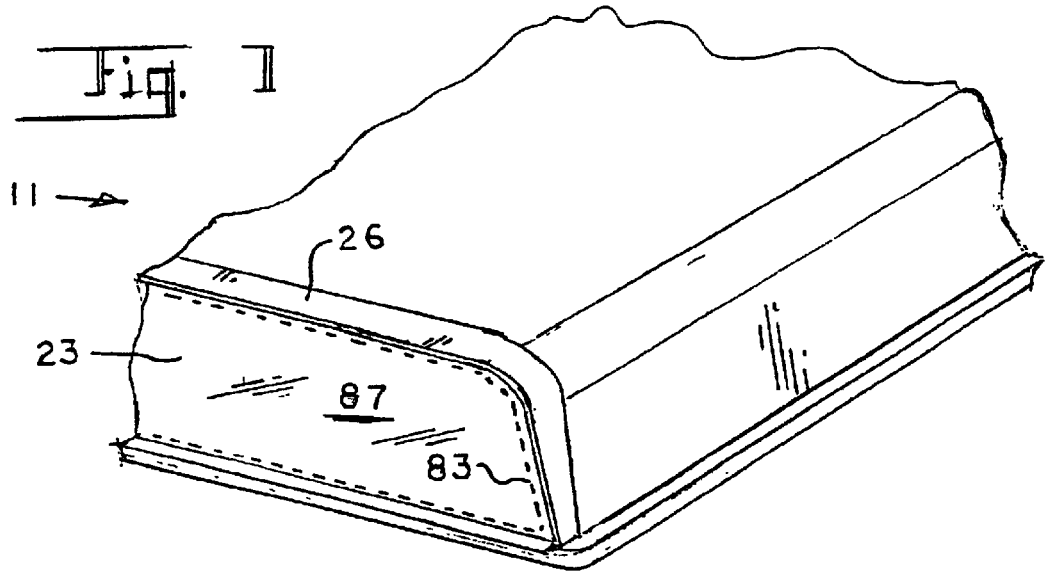
FIG. 7 is an enlarged partial, perspective view of the forward end of the completed package of FIG. 5.

FIG. 5 illustrates the completed package. Note how the front-end wall 23 has a line of perforations 83, also shown in the enlarged view of FIG. 7. This feature facilitates the removal of a flap 87 by tearing or cutting along the perforations.

Figure 8:
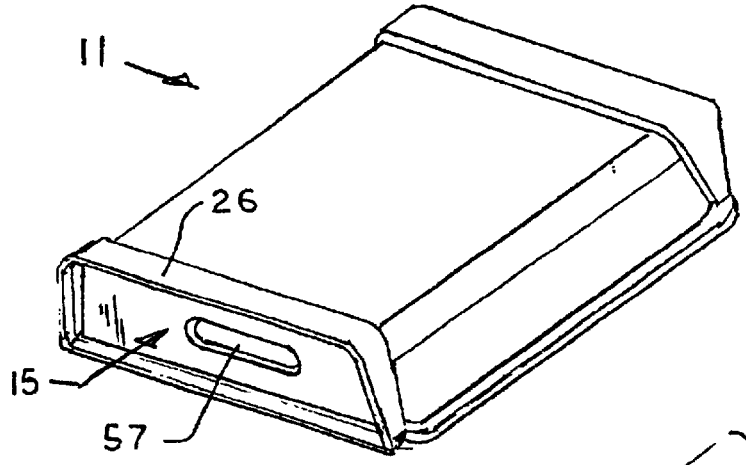
FIG. 8 is a perspective view of the completed package with the front end wall cut open to provide access to the article-mounting piece.
Figure 9:
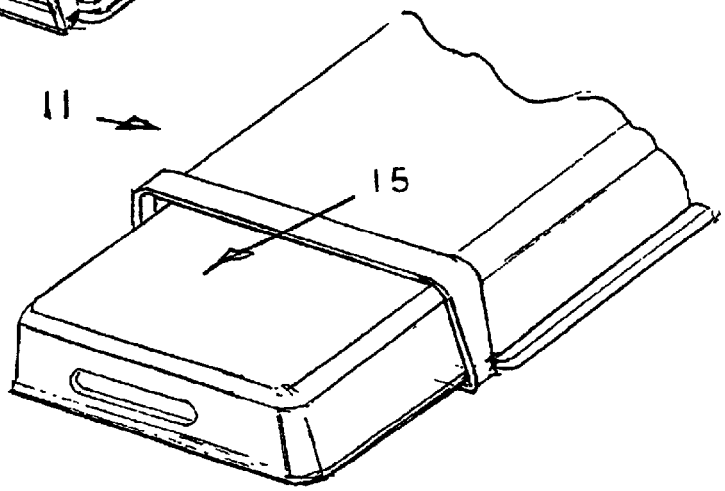
FIG. 9 is a view showing the article-mounting piece partially withdrawn from the completed package.

FIG. 8 shows package 11 with flap 87 removed which leaves a front opening large enough to allow article-carrying piece 15 to be slidably withdrawn from the package as FIG. 9 illustrates. The purchaser has the advantage of retaining the package 11 and using it for storing selected items as desired.

While a particular embodiment of the invention has been shown, it is not intended that the invention be limited thereto. Various modifications and variations of the invention will be evident to persons of ordinary skill in the art, given the benefit of this disclosure, and it is intended that the invention be given its full scope and breath as defined in the claims that follow.

What is claimed is:

1. A plastic package for small articles including:

a) a bottom piece including an upper portion, a front end, a rear end and a perimeter, and a front wall pivotally connected to said front end and a rear wall pivotally connected to said rear end, and latching means on each said front and rear walls;

b) an article-holding piece having at least one recess for receiving said articles, and a lower edge for engaging the upper portion of said bottom piece;

c) a cover piece including an upper wall, opposing side walls, a rear wall, and open front, and a lower edge that is adapted to make holding engagement with said bottom piece perimeter; and d) wherein said cover is adapted to cover said article-holding piece when said article-holding piece is positioned on the upper portion of said bottom piece and said cover lower edge is engaged with said bottom piece perimeter; and e) whereby said front and rear walls can be rotated upwardly to bring their latching means into engagement with opposing ends of said cover to secure the cover to the bottom piece.

2. A package as defined in claim 1 wherein said front and rear walls each have a lip portion on which said latching means is mounted.

3. A package as defined in claim 2 wherein said cover has connecting means on opposing ends of said cover for engaging the latching means on said lip portions.

4. A package as defined in claim 3 wherein said connecting means is a transverse ridge.

5. A package as defined in claim 3 wherein said connecting means is on the upper portions of said opposing ends.

6. A package as defined in claim 2 wherein said cover front opening is large enough for passage of said article-holding piece there through.

7. A package as defined in claim 2 wherein a major surface of said front wall is adapted to be torn away to provide an opening large enough for passage of said tray piece.

8. A package as defined in claim 7 wherein said major surface is delineated by perforations in said wall.

9. A package as defined in claim 2 wherein said cover lower edge is adapted to embrace said bottom piece perimeter.

10. A package as defined in claim 2 wherein said article-holding piece is slidably supported on said bottom piece.

11. A package as defined in claim 1 wherein said article-holding piece is slidably supported by said bottom piece.

* * * * *